United States Patent [19]

Miki et al.

[11] Patent Number: 4,586,437

[45] Date of Patent: May 6, 1986

[54] ELECTRONIC DELAY DETONATOR

[75] Inventors: Kosuke Miki, Sagamihara; Shiro Hiruta, Tokyo, both of Japan

[73] Assignee: Asahi Kasei Kogyo Kabushiki Kaisha, Japan

[21] Appl. No.: 601,699

[22] Filed: Apr. 18, 1984

[51] Int. Cl.[4] ..... F42C 11/06

[52] U.S. Cl. ..... 102/220; 102/206; 102/218

[58] Field of Search ..... 102/206, 218, 220, 215

[56] References Cited

U.S. PATENT DOCUMENTS

| | | | |
|---|---|---|---|
| 4,145,970 | 3/1979 | Hedberg et al. | 102/218 |
| 4,240,350 | 12/1980 | Munzel | 102/206 |
| 4,311,096 | 1/1982 | Oswald | 102/220 |
| 4,445,435 | 5/1984 | Oswald | 102/215 |
| 4,480,550 | 11/1984 | Abt | 102/215 |
| 4,487,125 | 12/1984 | Zuk | 102/220 |

FOREIGN PATENT DOCUMENTS

| | | |
|---|---|---|
| 54-43454 | 4/1979 | Japan . |
| 57-142496 | 9/1982 | Japan . |
| 57-142498 | 9/1982 | Japan . |

*Primary Examiner*—Charles T. Jordan

*Attorney, Agent, or Firm*—Finnegan, Henderson, Farabow, Garrett & Dunner

[57] ABSTRACT

An electronic delay detonator actuated after the lapse of a predetermined delay time from the application of an input power source, comprises a capacitor for storing the electrical energy supplied from the input power source, a diode bridge for preventing the stored electrical energy from being released reversely toward the input power source, a CR oscillator, a counter for generating a signal upon having counted a pulse signal produced from the CR oscillator by a predetermined number, and a thyristor driven by the signal for supplying the electrical energy stored in the capacitor to an ignition device in the detonator, the delay time being accurately determined by counting the pulses generated from the CR oscillator.

12 Claims, 7 Drawing Figures

ELECTRONIC DELAY DETONATOR

BACKGROUND OF THE INVENTION

The present invention relates to an electronic delay detonator for delayed detonation after the lapse of a predetermined delay time in response to a pulse-like ignition input voltage.

The conventional electric delay detonator specified in JIS K4807 (JIS is an abbreviation of Japanese Industrial Standard) is such that delay powder is arranged between an electric ignition device (platinum wire) and a charge to deal the detonation time. The control of the mixing of this delay powder and management of the charge amount thereof are very troublesome on the one hand, and the precision of the delay time is generally low on the other hand. In recent years, with the improved civil engineering technologies, there has been an increasing demand for an improved time accuracy of the delay detonator. So far, the accuracy of the electric delay detonator with delay powder has been limited to ±3 to 4% of a set delay time.

In view of this, some researchers have suggested an electronic delay detonator with an electrical circuit which is low in production cost and high in time accuracy. For technologies related to the electronic delay detonator, reference is made to Japanese Patent Laid-Open No. 43454/79 laid open on Apr. 6, 1979, Japanese Patent Laid-Open No. 142496/82 laid open on Sept. 3, 1982, Japanese Patent Laid-Open No. 142498/82 laid open on Sept. 3, 1982, and U.S. Pat. No. 4,240,350.

These electronic delay detonators are roughly classified into two types; an analog system comprising a time delay device including a series connection of a resistor and a capacitor in which the voltage across the capacitor is utilized, and a digital system comprising a CR oscillator circuit or a crystal oscillator circuit and a counter so that the pulses generated by the oscillator circuit are counted to attain a predetermined delay time.

The former detonator generally comprises a capacitor for storing electrical energy, a thyristor, an electrical ignition device (such as platinum wire) connected in series with the storage capacitor through the thyristor, a series connection of a resistor and a capacitor for driving the thyristor with a predetermined delay time after application of the electrical energy to the storage capacitor, a thyristor trigger device inserted between the gate of the thyristor and the time-delaying capacitor for applying the electrical energy stored in the time-delaying capacitor to the gate of the thyristor when the voltage across the time-delaying capacitor reaches a predetermined level, and a constant voltage circuit connected across the storage capacitor for applying a constant voltage across the time-delaying resistor and the capacitor regardless of the input voltage of the storage capacitor.

The electronic delay detonator with analog voltage, however, has different delay times depending on the voltage applied to the storage capacitor and temperature changes, and has not any conspicuous advantage as compared with the detonator with delay powder. Due to these facts and variations in electrical characteristics of parts to be used, it is difficult to produce such analog type detonators of practical use on a mass production basis.

Generally, the error of charge-discharge cycle under transient conditions increases with the capacitor's capacity. If this error is to be reduced to a minimum, the capacitor's capacity should desirably be minimized. In the electronic delay detonator with analog voltage, however, the time delaying capacitor is used to determine the delay time, and also used to fire the thyristor with the electrical energy stored therein. It is, therefore, impossible to use a capacitor of a capacity smaller than a predetermined value, resulting in the problem of impossibility of error reduction and the problem of the unavailability of a wide setting range of delay time.

In the digital system aimed at high accuracy of delay time, on the other hand, it is common practice to use an oscillator circuit including an oscillator such as a crystal oscillator or a ceramic oscillator or a CR oscillator circuit whereby the oscillation output is frequency-divided to effect accurate counting of the time. The detonator with a CR oscillator has the problem of insufficient accuracy of the oscillation frequency, while the oscillator circuit including a crystal oscillator or the like involves the following inconveniences in the delaying operation of the electronic delay detonator and is not of practical value. Specifically, the oscillation of a crystal oscillator or the like uses the vibrations by the mechanical displacement of a solid, and accordingly, it takes a long time such as several hundred milliseconds for the low-frequency oscillator or several tens of milliseconds for the high-frequency oscillator before a predetermined vibration frequency is established.

When one tries to delay the time accurately after the application of electrical ignition energy, therefore, the delay means using the crystal oscillator develops an error in delay time due to this initial unstable period of time, making it impossible to use the detonator reliably for delay blasting. If this initial unstable period is to be eliminated, it is necessary to excite the crystal oscillator circuit with another power supply in advance. In delay firing or ignition of detonators where electrical ignition energy is applied to all the detonators at a time for sequential detonations, however, it is practically impossible to supply stably necessary power to each detonator because power lines for the crystal oscillator circuits will be blasted and lost by explosion of a detonator to be previously exploded. Further, the ordinary electric detonator utilizes two wires for supplying the electrical ignition energy to the detonator, and the detonator utilizing such crystal oscillator circuit which requires an additional wire for supplying power thereto will increase the wiring work cost and is not economical.

If the oscillation frequency of the crystal oscillator is increased to a higher level such as over several tens of MHz, it is true that the initial unstable period is shortened to several milliseconds. With an increased number of steps of frequency-divider circuit for counting the delay time, however, the integrated circuits making up the frequency-dividing circuit is increased.

SUMMARY OF THE INVENTION

Accordingly, an object of the present invention is to provide an electronic delay detonator with an accurate delay time.

Another object of the present invention is to provide an electronic delay detonator in which the delay time can be set in a wide range.

Still another object of the present invention is to provide an electronic delay detonator which satisfies the requirements of compactness, low cost and high operating reliability.

According to one aspect of the present invention, there is provided an electronic delay detonator comprising a first capacitor for storing electrical energy, an oscillator having a second capacitor and a resistor, the oscillator generating pulses at cycles proportional to the product of the resistance value of the resistor and the capacitance of the second capacitor, a counter for counting the pulses by the number corresponding to a predetermined delay time and generating a drive signal upon completion of the counting, and means driven by the drive signal for applying the electrical energy stored in the first capacitor to an ignition device (such as platinum wire), thereby driving the ignition device with accurate delay time.

BRIEF DESCRIPTION OF THE DRAWINGS

The above and other objects, features and advantages will be made apparent by the detailed description taken in conjunction with the accompanying drawings, in which.

DESCRIPTION OF THE PREFERRED EMBODIMENTS

The present invention will now be explained in detail with reference to the various embodiments.

Embodiment 1

Figure 1:
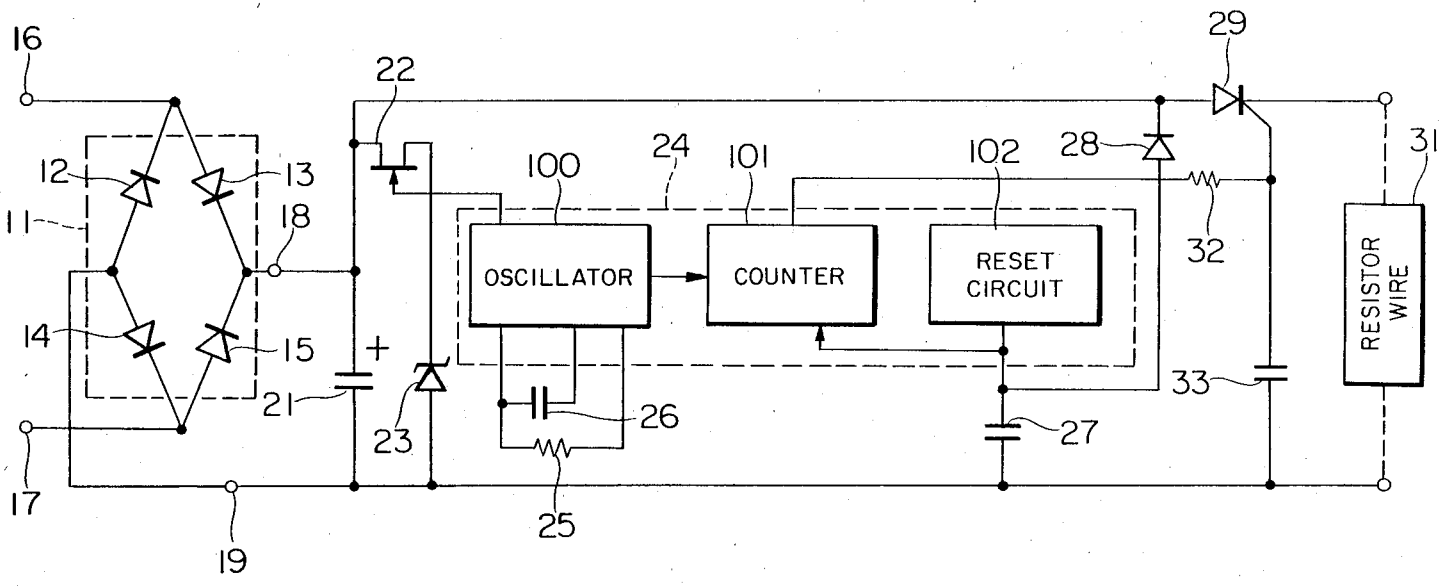
FIG. 1 is a schematic diagram showing a circuit according to an embodiment of the present invention.

A first embodiment of the invention is shown in FIG. 1. A diode bridge 11 includes diodes 12, 13 connected in series in a forward direction, and diodes 14, 15 also connected in series in a forward direction, the diode pairs being connected in parallel to each other. The junction point of the diodes 12 and 13 and the junction point of the diodes 14 and 15 are connected to input terminals 16 and 17, respectively, while the junction point of diodes 13 and 15 and the junction point of the diodes 12 and 14 are connected to terminals 18 and 19, respectively. As a result, even if the connection between terminals 16, 17 and the positive and negative sides of a blasting machine, respectively, are interchanged, a positive voltage is always produced at the terminal 18. Also, even when the terminals 16 and 17 are shorted by an explosion, the charges of a capacitor 21 for storing electrical energy connected between the terminals 18 and 19 are prevented from being released to the terminals 16, 17.

The pulse-like power applied between the input terminals 16 and 17 is smoothed and stored in the capacitor 21. The terminal 18 is connected to a terminal of a junction-type field-effect transistor 22 for constant current source, the other terminal of which is connected, together with the gate thereof, to the terminal 19 through a planar-type zener diode 23 for voltage regulation. In other words, the transistor 22 is diode-connected. The constant voltage produced from the junction point of the transistor 22 and the diode 23 is applied to the supply terminal of an integrated timer circuit 24 including an oscillator 100, a counter 101 and a counter reset circuit 102 made of C-MOS. The oscillator 100 of the timer circuit 24 is connected with a resistor 25 for determining the oscillation frequency and a temperature-compensated ceramic capacitor 26. Further, a reset capacitor 27 for preventing a counting error is connected to the reset terminal of the reset circuit 102 of the timer circuit 24. This reset terminal is connected to the terminal 18 through a diode 28 for discharging the chrages of the capacitor 27, in order to expedite the repetition test for delay time adjustment.

The terminal 18 is connected with the anode of the thyristor 29 which serves as a delay pulse output supply switch. The cathode of the thyristor 29 is connected to the terminal 19 through a load, that is, an ignition resistor 31 of the electronic delay detonator. The gate of the thyristor is connected through a buffer resistor 32 to the output terminal of the timer circuit 24 on the one hand, and to the terminal 19 through a noise-absorbing ceramic capacitor 33 on the other hand.

Figure 2:
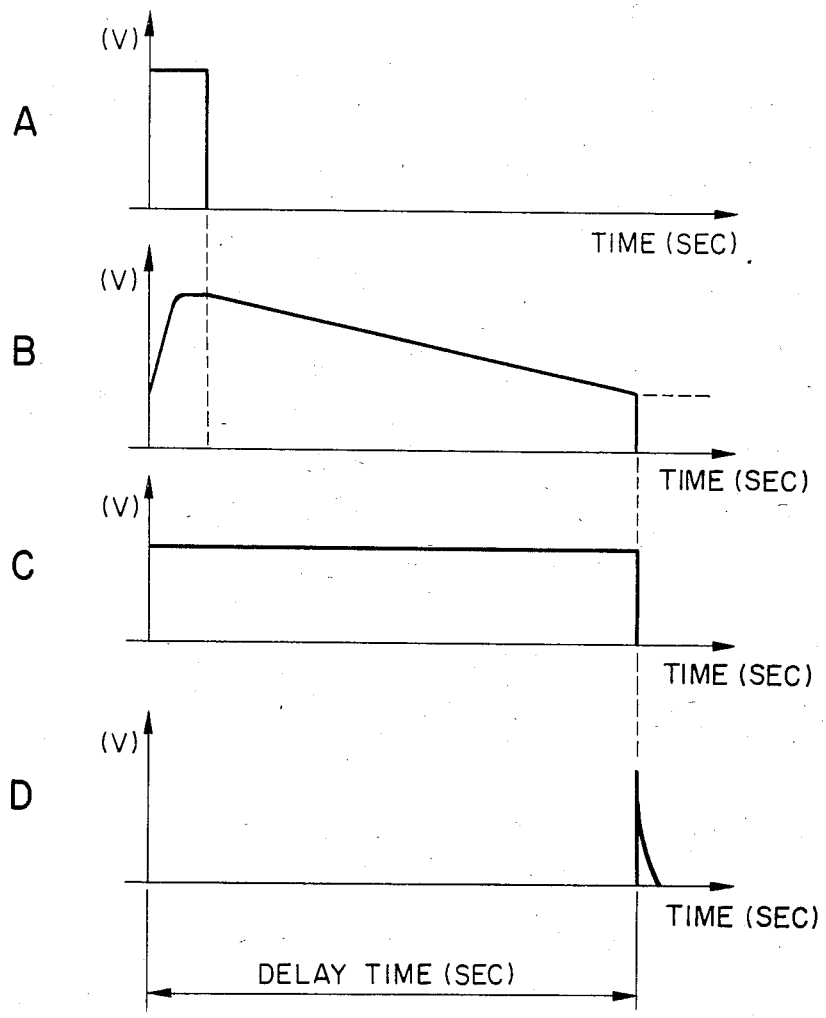
FIGS. 2, 3A and 3B are diagrams useful for explaining the embodiment of FIG. 1.

In this configuration, upon application of a pulse signal to be used as a source of an ignition energy for the electronic detonator between the terminals 16 and 17 from a blasting machine (not shown) as shown in FIG. 2A, the voltage between the terminals 18 and 19 of the capacitor 21 is smoothed as shown in FIG. 2B, which voltage is applied, as a constant voltage as shown in FIG. 2C, through the transistor 22 and diode 23, to the supply terminal of the timer circuit 24. As a result, the timer circuit is actuated and begins to oscillate at a period determined by the time constant of the capacitor 26 connected in series with the resistor 25.

Figure 3A:
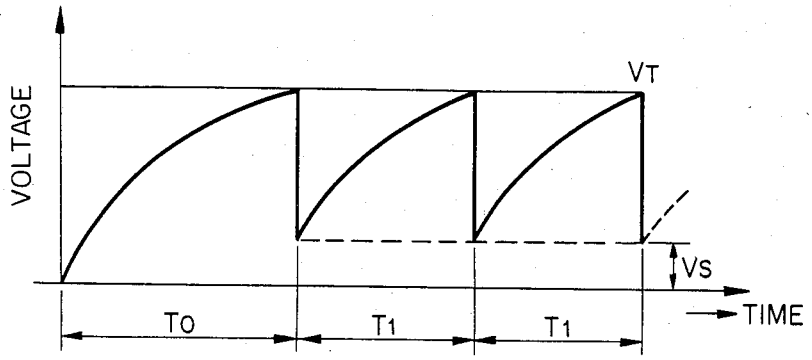
Figure 3B:
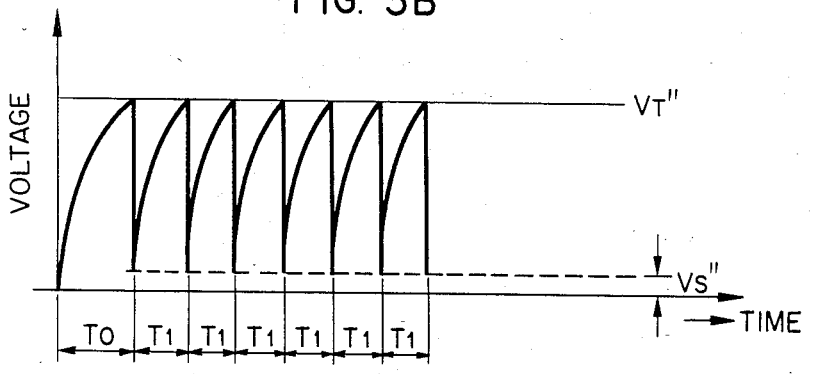

This waveform of oscillation is, for example, as shown in FIGS. 3A and 3B, in which when the capacity of the capacitor 26 is large, the period $T_1$ lengthens as shown in FIG. 3A, while if the capacity of the capacitor 26 is small, the period $T_1$ is shortened as shown in FIG. 3B. This oscillation signal is counted by the counter 101 in the timer circuit 24, and when the count reaches a predetermined value, that is, when a set-up time is reached, a set-up signal used for driving the thyristor 29 is produced from the output terminal of the timer circuit 24, so that the thyristor 29 is turned on, and the charges of the capacitor 21 are applied through the thyristor 29 in pulse form to the ignition resistor 31 as shown in FIG. 2D. The time t from the application of the pulse signal forming the energy source of ignition of the electronic detonator to the application of the pulse to the ignition resistor 31 makes up a delay time.

When the potential charged to the capacitor 26 reaches a threshold potential $V_T$ or $V_T''$ of an active switching element in the oscillator 100, the oscillation is turned on by the charge-discharge of the capacitor 26, so that the charges are rapidly released from the capacitor 26. As a result, the active switching element is turned off again, so that the charging is resumed. This operation causes continued oscillation, thereby producing an oscillation waveform as shown in FIG. 3A or FIG. 3B. In FIGS. 3A and 3B, $V_T$ designates a threshold value obtained when a comparatively large-capacity capacitor is used as the capacitor 26, and $V_T''$ that obtained when a capacitor of a comparatively small capacitance is used as the capacitor 26. The charges in the capacitor 26 are not completely released due to the internal resistance of the capacitor 26 even at the time of shorting, that is, upon turning on of the active switching element, and is normally charged again when the off-threshold value of the active switching element is reached. $V_S$ and $V_S''$ in FIGS. 3A and 3B represent the off-threshold values (potential of residual charges) corresponding to the large-capacity capacitor 26 and the small-capacity capacitor 26, and in this case, $V_S''$ is smaller than $V_S$. When the capacity of the capacitor 26 is especially large, the discharge current increases to such a degree that variations of ON-resistance of the active switching element poses a very great cause of error. Also, the source voltage-caused drift and the temperature-caused drift of the threshold voltage of the active switching element are another cause of an error in variation of oscillation frequency.

The embodiment under consideration is intended to realize a stable CR oscillator circuit operating on the basis of repetition of charge-discharge of the capacitor, which has so far been considered not very practical due to many factors of instability. It is conventionally known that such active switching elements as a bypolar transistor and a thyristor undergo a drift of threshold potential with temperature or voltage. The CR oscillation, which generally lacks the frequency stability, is not used in important applications. Nevertheless, the stability of threshold voltage of the C-MOS circuit element (complementary field-effect transistor) has been remarkably improved as compared with the conventional active devices, since the C-MOS circuit element, with its low power consumption, is such that the P-channel and N-channel field-effect transistors function in complementary manner, and especially, the threshold voltages of the P-channel and N-channel field-effect transistors have opposite temperature coefficients to each other. And further, in view of the field-effect transistor being a voltage-controlled device, the change of the threshold voltage due to the change of the source voltage is not dependent upon the change of resistance of the P- and N-channel field-effect transistors and is fixed almost to one half of the source voltage, unlike the conventional switch circuits with a bipolar transistor.

In this embodiment, the timer circuit 24 formed of C-MOS circuit elements with an improved stability as compared with the above-mentioned active elements is used, with the result that stable operation is attained over wide ranges of temperature and input pulse voltage with high delay time accuracy.

Also, according to this embodiment, the capacitor 26 is used only to determine the oscillation frequency, and therefore it is possible to use a small-capacity capacitor so that the range of capacity selection thereof is not limited or the circuit function is not affected by the variations in ON-resistance of the active switching element in the oscillator 100. As a result, the delay time may be determined accurately over a wide range. The setting of the delay time may be effected by changing the values of the capacitor and/or the resistor 26.

For the reason mentioned above, the capacity of the capacitor 26 is desirably small. If the circuit portion is sealed with epoxy resin or the like, however, the floating capacity and the capacity between the capacitor terminals would be greatly effected, thus making it difficult to determine a constant charge-discharge oscillation frequency of the capacitor and resistor.

According to the present invention, the capacity of the capacitor needs not be very small but may be chosen such that the discharge current from the capacitor lies within the discharge current range of the active elements combined therewith, thus permitting the setting of the delay time over a wide range. In this embodiment, the capacitance of the capacitor 26 may preferably lie in the range of about 100 to 1000 pF.

In the present embodiment, the junction-type field-effect transistor 22 and the zener diode 23 make up a voltage-regulation circuit. On the other hand, a conventional circuit uses a resistor and zener diode, which has the disadvantage of unstable operation due to the current change depending upon the applied voltage thereacross. In an improvement of this circuit, a field-effect transistor is used as a constant-current element. In a combination of a MOS field-effect transistor and a zenor diode, however, the disadvantage of temperature dependency is not eliminated in spite of the advantage of some effect of constant current obtained.

According to the present invention, this shortcoming has been obviated by a combination of a zener diode and a junction-type field-effect transistor as a voltage regulation circuit. Specifically, the gate-source voltage of a junction-type field effect transistor 22 is set in a region where the drain current is stable against temperature change and, as a minor constant-current source, a planer-type zener diode 23 of about 5 V comparatively stable with temperature change is combined, so that the operation of the timer circuit 24 is stabilized with an improved time accuracy on the one hand, and the capacity of the capacitor 21 is reduced by employing the drain current of 1 mA or less for an increased pulse energy on the other hand.

Further, since the C-MOS timer circuit 24 with a small current consumption is used, the blasting machine (electrical energy source) need not be specially bulky as compared with TTL and may be powered by a layer-built dry cell or the like. Also, the pulse signal to be used as a power source is used both for both power source of the timer circuit 24 and the ignition energy of the ignition resistor 31 without increasing the capacity of the capacitor 21.

Embodiment 2

The ignition of the electric detonator is usually made instantaneously with electrical pulse energy. The switch elements such as a thryistor are susceptible to noises of small pulse width generated under transient conditions.

Figure 5:
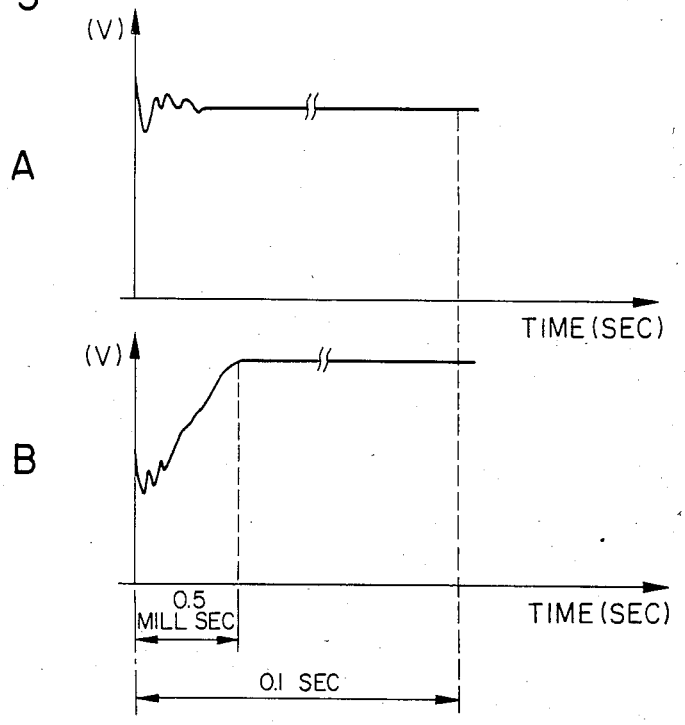
FIG. 5 is a diagram useful for explaining the embodiment of FIG. 4.

With reference to FIGS. 5A and 5B, upon application to the electric detonator of a pulse signal making up an energy source for ignition of the electric detonator, a noise is superimposed on the pulse signal as shown in FIG. 5A, for instance, which often causes a number of noises of small pulse width in the voltage across the capacitor 21 as shown in FIG. 5B. Therefore, if the gate of the thyristor 29 is left open, these pulse noises may erroneously turn it on, thus erroneously supplying output energy to the ignition resistor 31.

To eliminate this inconvenience, it is desirable to short the gate terminal of the thyristor 29 with a high-speed switching element at the time of applying the pulse signal making up an energy source.

Figure 4:
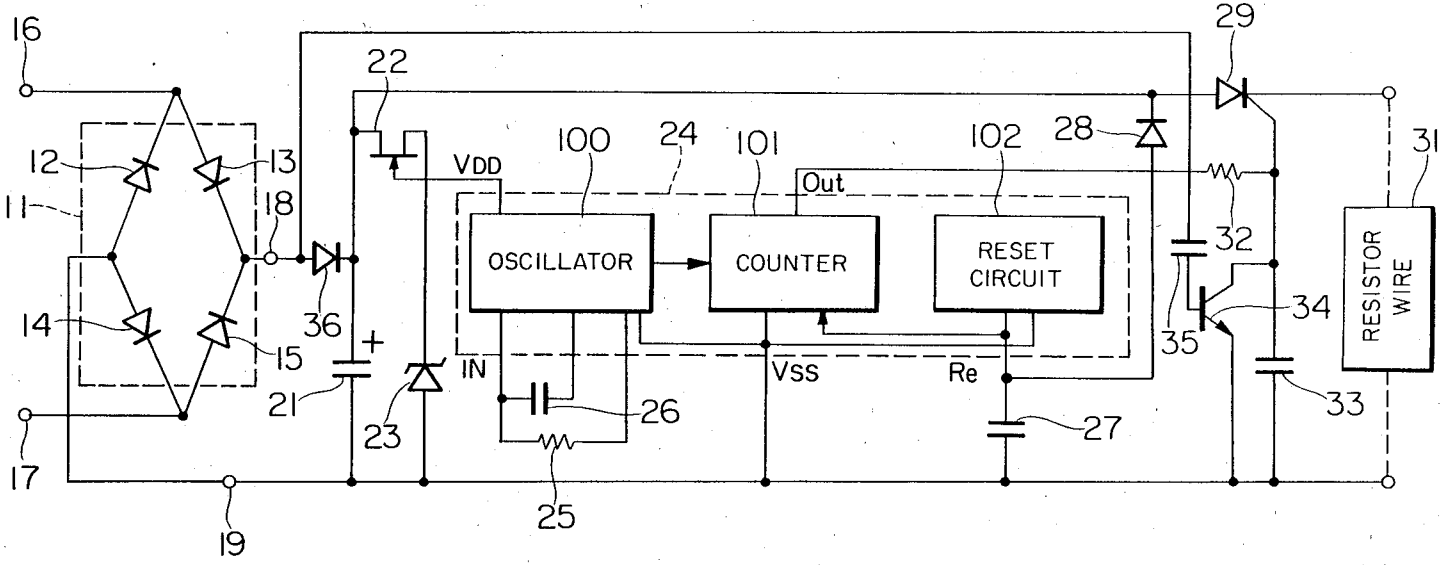
FIG. 4 is a schematic circuit diagram showing another embodiment of the present invention.

The embodiment shown in FIG. 4 takes this idea into consideration. Those component elements in FIG. 1 which are similar to those in FIG. 1 designated with similar numerals are not described again. As shown in FIG. 4, the base of a high-speed switching transistor 34 is connected with the terminal 18 through an impedance element 35 such as a capacitor, the collector thereof to the gate to the thyristor 29, and the emitter thereof to the terminal 19. Upon application of power, the switching transistor 34 is turned on so that the gate of the thyristor 29 is shorted, and the lapse of an unstable period of time $T_a$ (FIG. 5), the transistor 34 is turned off to place the gate of the thyristor 29 in a respective mode. In this way, stable operation is secured even against the noises generated by the rapid rise or the like of the pulse signal. In FIG. 4, a diode 36 is inserted between the terminal 18 and the junction point of the capacitor 21 and the transistor 22.

According to the present invention, it is possible to provide a compact, low-cost delay detonator with stable time accuracy, as compared with the conventional delay detonators with delay powder. If the delay pulse generator circuit 37 is integrated with the detonator, an LSI including an integration of a C-MOS oscillator circuit and a frequency-divider circuit or a counter circuit may be combined with a chip capacitor, a chip resistor, a mini mold transistor, a mini mold thyristor, a mini mold zener diode and a mini mold field effect transistor to obtain a hybrid configuration, thus making it possible to contain the circuit devices in a compact body of the electric detonator which is comparable in size with the conventional delay detonators widely used.

As the timer circuit 24, M58482 or M0251P of Mitsubishi Electric Corporation or TC5043C of Toshiba Corporation may be used.

Figure 6:
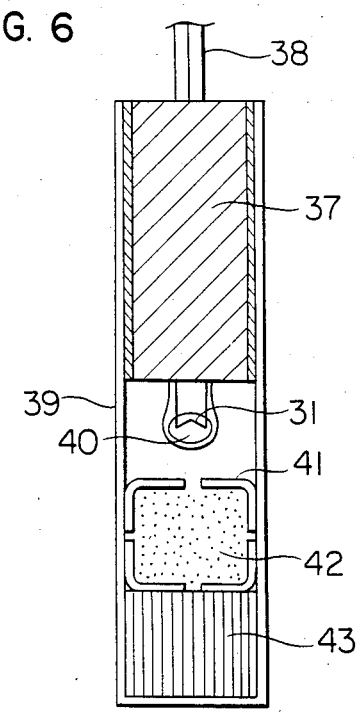
FIG. 6 is a diagram showing a schematic construction of an electronic delay detonator according to the present invention.

An example in which the delay pulse generator circuit is incorporated in the electric detonator is shown in FIG. 6. Specifically, a base charge 43 is inserted into a shell 39 with a closed end. The primer charge 42 contained in the inner capsule 41 is inserted into the shell 39. After some time interval, the pulse generator 37 with a delay pulse generator circuit such as shown in FIGS. 1 or 4 built therein is inserted into the shell 39. The ignition resistor 31 made of an resistor wire is arranged on the initiator or primer charge 42 side of the pulse generator 37, and ignition device made of an ignition powder 40 is attached to the ignition resistor 31. Leg wires 38 are led out from the outer end of the pulse generator 37.

We claim:

1. An electronic delay detonator for driving an ignition device with a predetermined time delay by being supplied with electrical energy, comprising:

input terminal means for supplying the electrical energy to said delay detonator;

a first capacitor for storing said electrical energy;

means inserted between said input terminal means and said first capacitor for preventing said stored electrical energy from being released through said input terminal means;

oscillator means electrically connected to said first capacitor and including a resistor and a second capacitor, for producing a plurality of pulse signals of a period proportional to the product of the resistance value of said resistor and the capacitance value of said second capacitor. said oscillator means also including a C-MOS integrated circuit;

means connected across said first capacitor for generating a constant voltage, said constant voltage generating means including a series connection of a diode-connected junction-type field effect transistor and a zener diode, said C-MOS integrated circuit being operated by said constant voltage generated across said zener diode;

means for counting said plurality of pulse signals and for producing a first signal upon counting said pulse signals up to a number corresponding to said predetermined delay time; and means responsive to said first signal for supplying the electrical energy stored in said first capacitor to said ignition device.

2. An electronic delay detonator according to claim 1, wherein said zener diode comprises a planar type zener diode.

3. An electronic delay detontor according to claim 1, wherein the capacitance of said second capacitor lies in the range of substantially 100 to 1,000 pF.

4. An electronic delay detonator according to claim 1, wherein said preventing means includes a plurality of diodes in bridge connection.

5. An electronic delay detonator according to claim 1, wherein said supply means includes a thyristor inserted between said first capacitor and said ignition device, the gate of said thyristor being supplied with said first signal.

6. An electronic delay detonator according to claim 5, further comprising a transistor and a third capacitor, the collector and emitter of said transistor being connected respectively to the gate and cathode of said thyristor, one end of said third capacitor being connected to said first capacitor, and the other end of said third capacitor being connected to the base of said transistor.

7. An electronic delay detonator according to claim 1, wherein the capacitance of said second capacitor lies in the range of substantially 100 to 1,000 pF.

8. An electronic delay detonator for driving an ignition device with a predetermined time delay by being supplied with electrical energy, comprising:

input terminal means for supplying the electrical energy to said delay detonator;

a first capacitor for storing said electrical energy;

means inserted between said input terminal means and said first capacitor for preventing said stored electrical energy from being released through saiid input terminal means;

oscillator means electrically connected to said first capacitor and including a resistor and a second capacitor, for producing a plurality of pulse signals of a period proportional to the product of the resistance value of said resistor and the capacitance value of said second capacitor, said oscillator means also including a C-MOS integrated circuit;

means connected between said first capacitor and said oscillator means for stabilizing the operation of said oscillator means, said stabilizing means including a series connection of a diode-connected junction-type field effect transistor and a zener diode, said C-MOS integrated circuit being operated by a voltage generated across said zener diode;

means for counting said plurality of pulse signals and for producing a first signal upon counting said pulse signals up to a number corresponding to said predetermined delay time; and means responsive to said first signal for supplying the electrical energy stored in said first capacitor to said ignition device, said supplying means including a thyristor inserted between said first capacitor and said ignition device, said thyristor having a gate and a cathode, the gate being supplied with said first signal.

9. An electronic delay detonator according to claim 8 wherein said zener diode comprises a planar type zener diode.

10. An electronic delay detonator according to claim 8, wherein the capacitance of said second capacitor lies in the range of substantially 100 to 1,000 pF.

11. An electronic delay detonator according to claim 8, further comprising a transistor and a third capacitor, said transistor having a base, a collector and an emitter, the collector and the emitter being connected to the gate and the cathode of said thyristor, respectively, one end of said third capacitor being connected to said first capacitor, and the other end of said third capacitor being connected to a base of said transistor.

12. An electronic delay detonator according to claim 11, wherein the capacitance of said second capacitor lies in the range of substantially 100 to 1,000 pF.

* * * * *